US005580316A

United States Patent [19]

Hill et al.

[11] Patent Number: 5,580,316

[45] Date of Patent: Dec. 3, 1996

[54] FOLDABLE PLAY STRUCTURE

[75] Inventors: Peter C. Hill, Plano; Scott J. Duplantis, Fort Worth, both of Tex.

[73] Assignee: Today's Kids, Inc., Booneville, Ark.

[21] Appl. No.: 191,987

[22] Filed: Feb. 4, 1994

[51] Int. Cl.[6] ..... A63G 21/00

[52] U.S. Cl. ..... 472/116; 16/344; 16/351; 16/353

[58] Field of Search ..... 472/116; 16/DIG. 13, 16/DIG. 19, 355, 374, 337, 334, 344, 351, 353; 482/5

[56] References Cited

U.S. PATENT DOCUMENTS

| | | | |
|---|---|---|---|
| 220,429 | 10/1879 | Russell . | |
| D. 224,247 | 7/1972 | Jamison . | |
| D. 303,643 | 4/1989 | Conti et al. . | |
| D. 303,826 | 10/1989 | Aker . | |
| D. 311,941 | 11/1990 | Thomson et al. . | |
| D. 333,328 | 2/1993 | Aker et al. . | |
| D. 334,610 | 4/1993 | Aker . | |
| 336,469 | 2/1886 | Bornarth . | |
| 1,062,623 | 5/1913 | Waters . | |
| 1,337,817 | 4/1920 | Bode | 16/374 X |
| 1,505,192 | 8/1924 | Gervais, Jr. . | |
| 1,508,013 | 9/1924 | DeWaters . | |
| 1,918,375 | 7/1933 | Bowersock et al. . | |
| 1,959,664 | 5/1934 | Fuqua et al. . | |
| 3,231,942 | 2/1966 | O'Brien . | |
| 3,548,552 | 12/1970 | McBride . | |
| 3,561,757 | 2/1971 | Schillig | 472/116 X |
| 3,744,085 | 7/1973 | Griego | 16/144 |
| 3,969,871 | 7/1976 | Ewers | 472/116 X |
| 4,112,635 | 9/1978 | Rylander . | |
| 4,122,638 | 10/1978 | O'Brian et al. . | |
| 4,434,525 | 3/1984 | LaBelle | 16/355 |
| 4,501,045 | 2/1985 | Boyer . | |
| 4,864,688 | 9/1989 | Gerber | 16/DIG. 29 X |
| 4,964,249 | 10/1990 | Payne . | |
| 5,193,695 | 3/1993 | Mann . | |

OTHER PUBLICATIONS

Advertisement in Today's Kids' 1992 catalog for the Toddler Playground.

Advertisement in Today's Kids' 1992 catalog for the Kids' Play Place.

Advertisement in Today's Kids' 1993 catalog for the Infant Toddler Playland.

*Primary Examiner*—Carl D. Friedman
*Assistant Examiner*—Beth A. Aubrey
*Attorney, Agent, or Firm*—Kirkpatrick & Lockhart LLP

[57] ABSTRACT

A foldable play structure is disclosed which includes a first wall unit, a second wall unit, and a first axially latchable hinge. The first hinge includes a first leaf attached to the first wall unit, a second leaf attached to the second wall unit, and a first pintle extending through the first and second leaves along a first axis. The first and second leaves are slidable relative to each other along the first axis between a pivotable position, wherein the first and second leaves may pivot relative to each other about the first axis, and a latched position, wherein pivotal movement of the first and second leaves about the first axis is restrained.

18 Claims, 6 Drawing Sheets

FOLDABLE PLAY STRUCTURE

BACKGROUND OF THE INVENTION

1. Field of the Invention

The present invention relates to structures useful for children's play. More particularly, the present invention relates to foldable play structures.

2. Description of the Invention's Background

Numerous types of structures have been developed in the past which are adapted for play by children. Often these structures offer children the option of several types of play activities in one structure. For example, U.S. Pat. No. Des. 303,826 to Aker discloses an ornamental design for a combined climber and slide for children. U.S. Pat. No. Des. 334,610 to Aker discloses an activity slide toy which appears to offer children both a slide and a tunnel. U.S. Pat. No. Des. 224,247 to Jamison discloses an ornamental design for a combined playground treehouse and slide.

Structures of the type disclosed in the above-noted patents often have the disadvantage that they are rather large, and thus take up a lot of space, but are not easily folded or reduced in size for storage when they are not in use. Such structures are thus often more suitable for outside use, and are less suitable for indoor use.

Other structures are known which are designed for children's play and which are to some degree foldable so that they may be reduced in size when not in use. Structures of this type often have the disadvantage, however, of failing to include walls which are latchable in opened positions, and such structures thus run a relatively greater risk of collapsing when a child is inside of them. U.S. Pat. No. 4,964,249 to Payne, U.S. Pat. No. 4,122,638 to O'Brien, et al., and U.S. Pat. No. 1,918,375 to Bowerstock, et al. disclose foldable structures lacking such latching.

Other structures of this type include some means to latch walls of the structures in opened positions. For example, U.S. Pat. No. 4,112,635 to Rylander discloses engagements 43 between the free end of a flap 40 and a flange 16 to securely retain the flap 40 in an assembled position, and U.S. Pat. No. 3,231,942 to O'Brien discloses upper and lower latches 66, 68 to secure end walls in straightened positions. Structures which do include latching means, however, generally have the disadvantage of being relatively more time-consuming to assemble and disassemble.

In view of the above, it is an object of the present invention to provide an improved foldable play structure.

It is another object of the present invention to provide a foldable play structure which offers children several types of play activities.

A further object of the present invention is to provide a foldable play structure which can be folded and stored when not in use.

A further object of the present invention is to provide a foldable play structure which is suitable for either indoor or outdoor use.

Yet another object of the present invention is to provide a foldable play structure having wall units which are latchable when in an opened position.

It is a further object of the present invention to provide a foldable play structure which is relatively quickly and easily moved from a folded position to a latched, opened position.

SUMMARY OF THE INVENTION

The above objects as well as other objects not specifically enumerated are accomplished by a folding play structure in accordance with the present invention. The foldable play structure of the present invention includes a first wall unit, a second wall unit, and a first axially latchable hinge. The first hinge includes a first leaf attached to the first wall unit, a second leaf attached to the second wall unit, and a first pintle extending through the first and second leaves along a first axis. The first and second leaves are slidable relative to each other along the first axis between a pivotable position, wherein the first and second leaves may pivot relative to each other about the first axis, and a latched position, wherein pivotal movement of the first and second leaves about the first axis is restrained.

The objects of the invention are also accomplished by a foldable play structure which includes a first wall unit, a second wall unit, and a first axially latchable hinge. The first hinge includes a first leaf attached to the first wall unit, a second leaf attached to the second wall unit, and first restraining means for restraining movement of the first and second leaves relative to each other about a first axis. The first hinge further includes first connecting means for slidably connecting the first and second leaves to enable the first and second leaves to slide relative to each along the first axis between a latched position, wherein the first restraining means restrains pivotal movement, and a pivotable position, wherein the first and second leaves may pivot relative to each other about the first axis.

A foldable play structure may include four wall units connected together in a closed loop by four axially latchable hinges. Leaves of each of the hinges may be slidable relative to each other between pivotable positions, wherein the leaves may pivot relative to each other, and latched positions, wherein relative pivotal movement of the leaves is restrained.

BRIEF DESCRIPTION OF THE DRAWINGS

The preferred embodiment of the present invention will be described in greater detail with reference to the accompanying drawings, wherein like members bear like reference numerals and wherein.

DETAILED DESCRIPTION OF THE PREFERRED EMBODIMENT

Figure 1:
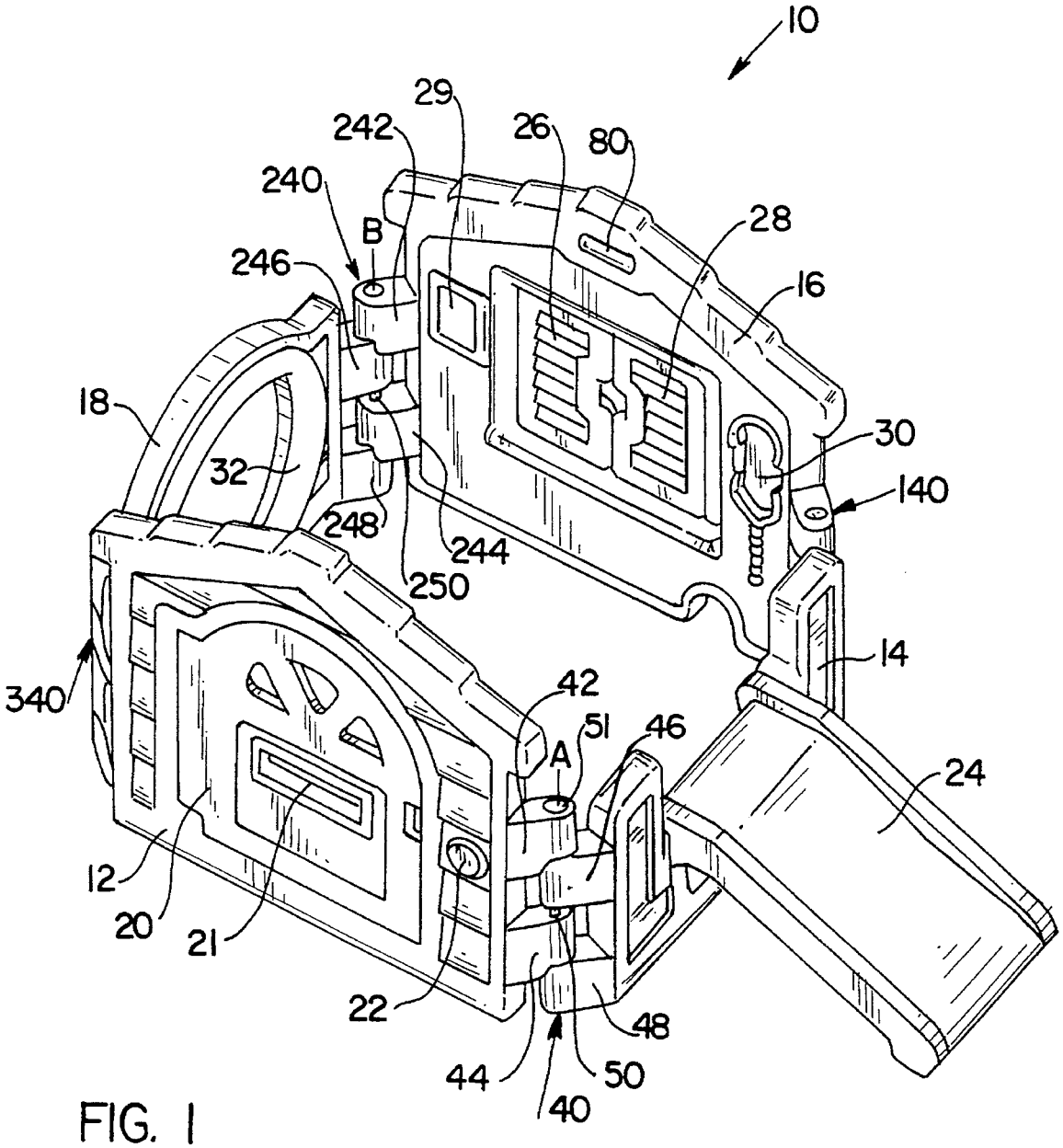
FIG. 1 is a perspective view of a foldable play structure of the present invention in an opened position.

With reference to FIGS. 1–7, a foldable play structure 10 in accordance with an embodiment of the present invention includes four wall units 12, 14, 16, 18. Each of the wall units 12, 14, 16, 18 is preferably formed of a blow-molded plastic, such as blow-molded polyethylene, although it may be formed of any suitable material, or by any suitable method, such as roto-molding. Each wall unit 12, 14, 16, 18 is designed to present one or more play activities for children. For example, the wall unit 12 includes a door 20 having a mail slot 21 therein, a doorbell 22, a clicking door key (not shown), a clicking light switch (not shown), and a note clip (not shown). The wall unit 14 includes a slide 24. The wall unit 16 includes a window with shutters 26, 28, a picture frame 29, and an opening 30 for a play portable phone. The wall unit 18 includes a tunnel element 32.

The wall units 12, 14, 16, 18 are connected together in a closed loop by four axially latchable hinges 40, 140, 240, 340 which are substantially identical. Only the hinge 40 will be discussed in detail hereinbelow, but it is to be understood that the discussion applies to each and every one of the axially latchable hinges 40, 140, 240, 340. As shown in FIG. 1, the hinge 40 includes a pair of leaves 42, 44 attached to the wall unit 12 and a pair of leaves 46, 48 attached to the wall unit 14, and, consequently, the hinge 240 includes a pair of leaves 242, 244 attached to the wall 16 and a pair of leaves 246, 248 attached to the wall unit 18. The hinges 140, 340 are similarly constructed.

Figure 3:
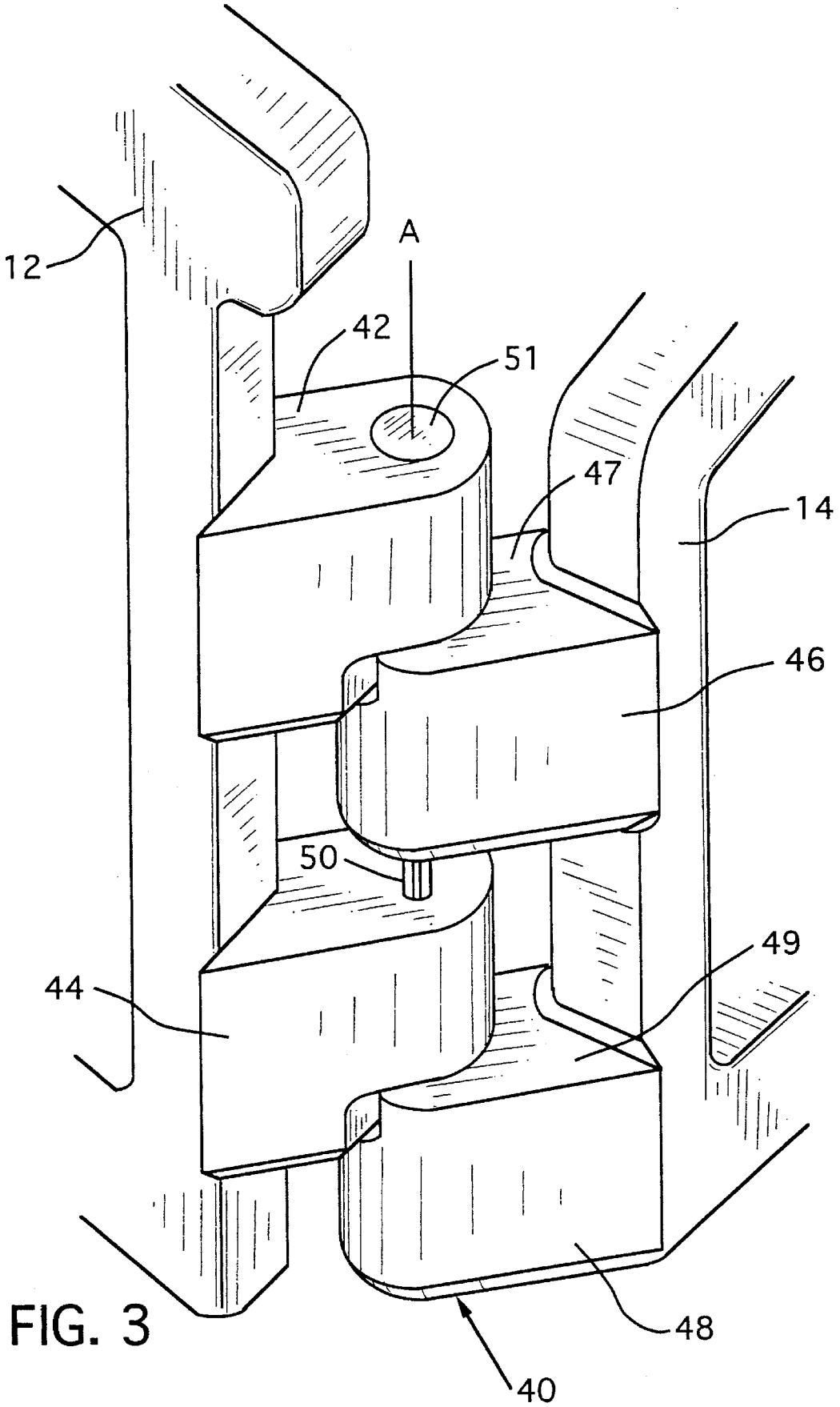
FIG. 3 is a perspective view of an axially latchable hinge of the foldable play structure of FIG. 1.
Figure 4:
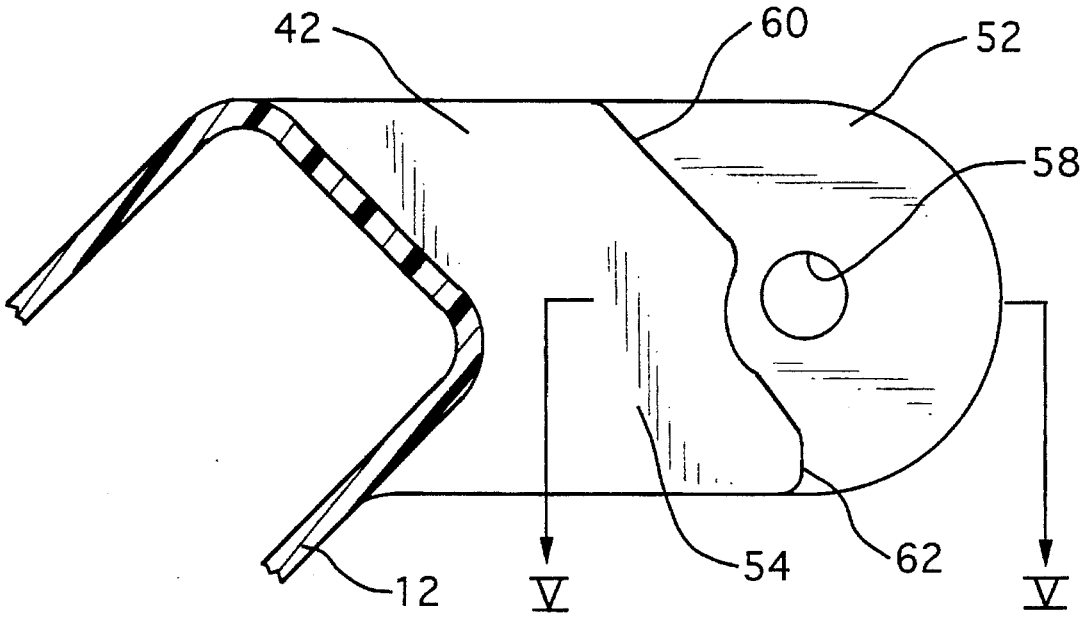
FIG. 4 is a bottom view of a leaf of the hinge of FIG. 3.
Figure 5:
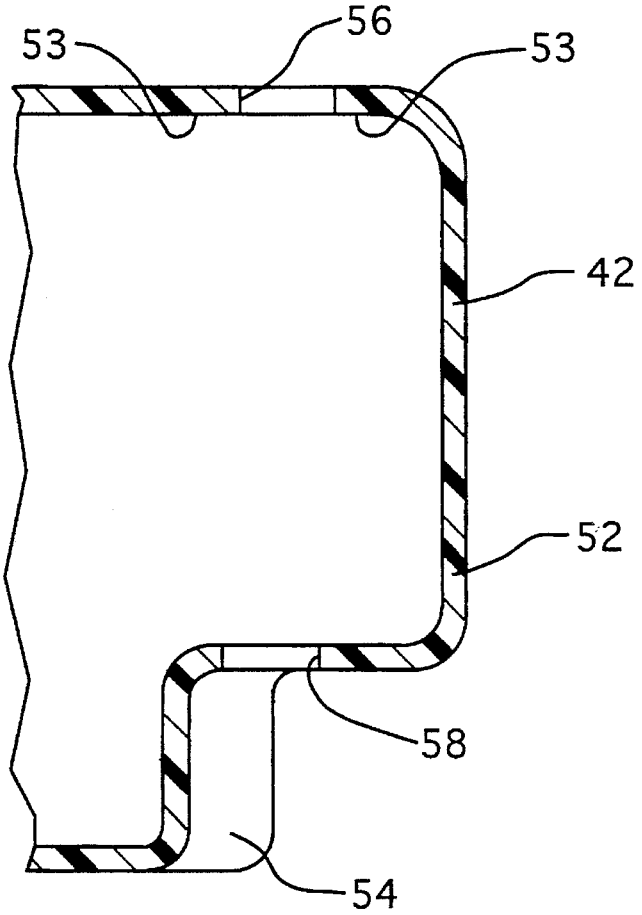
FIG. 5 is a cross sectional view along line V—V of FIG. 4.
Figure 8:
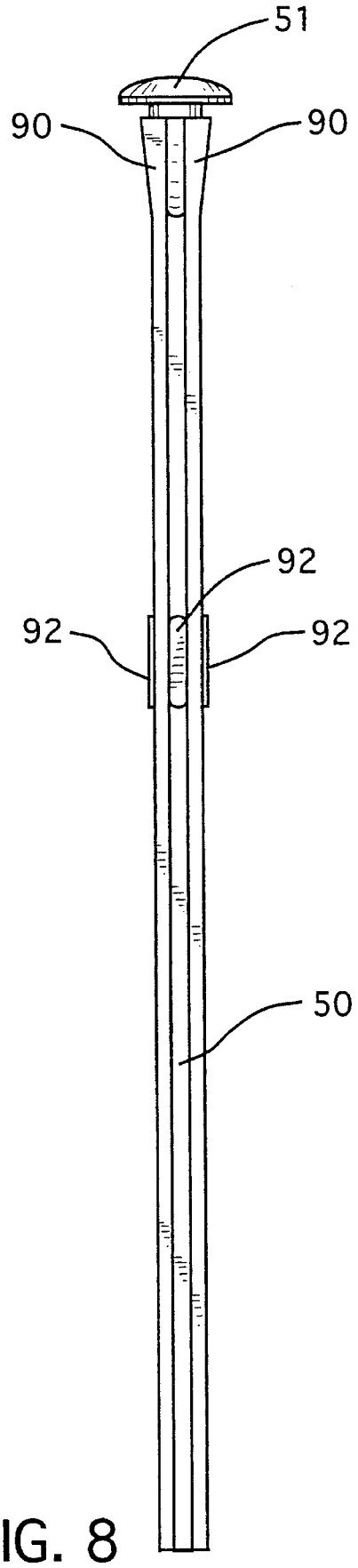
FIG. 8 is a front elevational view of a pintle of the hinge of FIG. 3.

As shown in FIGS. 3, the leaves 42, 44, 46, 48 are interleaved such that the leaf 42 is directly above the leaf 46, and the leaf 44 is directly above the leaf 48. A pintle 50 extends along a first axis A through the leaves 42, 46, 44, and into the leaf 48, as will be described more fully hereinbelow. As seen in FIGS. 4 and 5, the leaf 42 is preferably formed of a blow-molded plastic, such as blow-molded polyethylene, and includes a leaf body 52 and a stop projection 54. The leaf body 52 has a pair of holes 56, 58 therethrough for the pintle 50 to pass through. The pintle 50 is preferably formed of an injection-molded plastic, has a cross-shaped cross section, and, as shown in FIG. 8, includes four radially extending projections 90 just below a head 51 thereof. The projections 90, when the hinge 40 is assembled, are pushed through the hole 56 such that they abut an inner surface 53 of the leaf body 52 adjacent the hole 56, and thereby retain the pintle 50 to the leaf 42. The pintle 50 also includes four medial projections 92 thereon, as will be explained hereinbelow.

The stop projection 54 has located thereon a pair of stop surfaces 60, 62 which are spaced from each other circumferentially about the hole 58 such that when the hinge 40 is assembled, the stop surfaces 60, 62 are spaced about the pintle 50. The stop surfaces 60, 62 are generally planar and are generally parallel to the first axis A.

The leaf 44 is identical to the leaf 42. It should be appreciated, however, that projections of the pintle 50 do not contact the leaf 44 in the manner the projections 90 of the pintle 50 abut the inner surface 53 of the leaf body 52.

Figure 6:
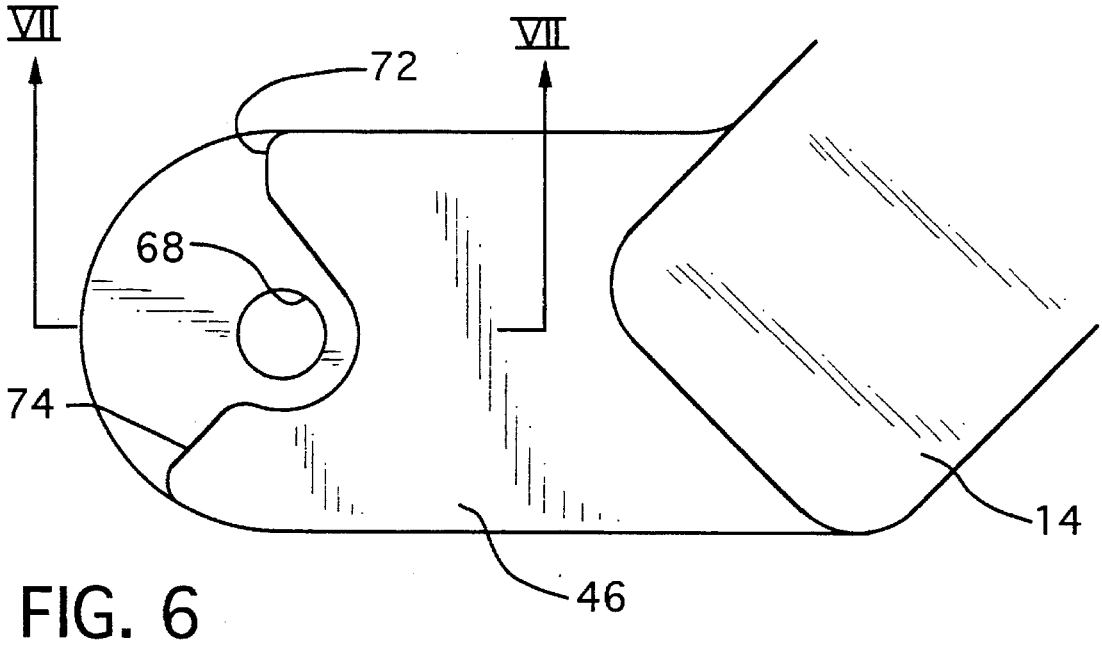
FIG. 6 is a top view of another leaf of the hinge of FIG. 3.
Figure 7:
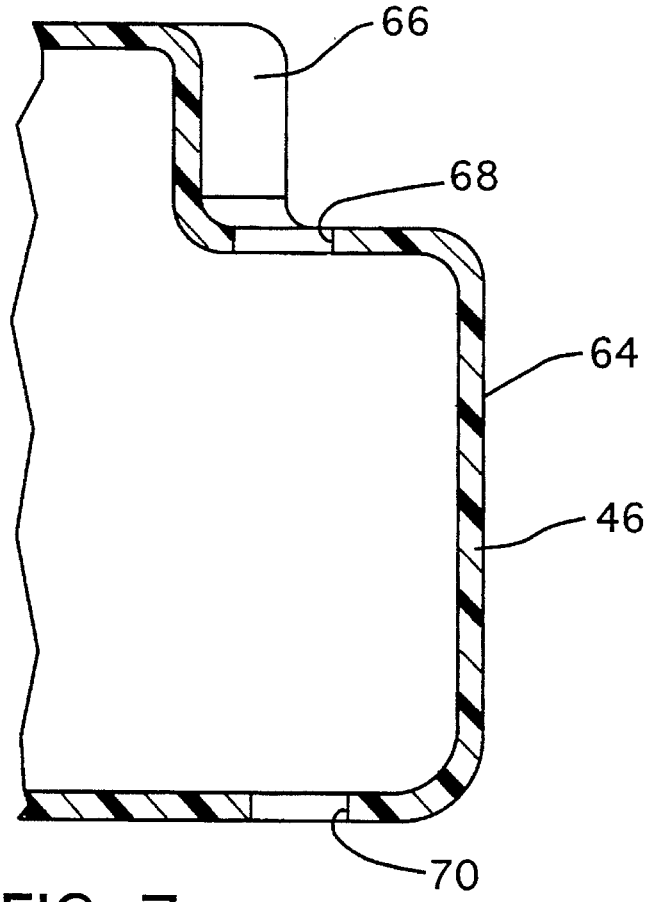
FIG. 7 is a cross sectional view along line VII—VII of FIG. 6.

As shown in FIGS. 6 and 7, the leaf 46 is preferably formed of a blow-molded plastic, such as blow-molded polyethylene, and includes a leaf body 64 and a stop projection 66. The leaf body 64 has a pair of holes 68, 70 therethrough for the pintle 50 to pass through. The stop projection 66 has located thereon a pair of stop surfaces 72, 74 which are spaced from each other circumferentially about the hole 68 such that when the hinge 40 is assembled, the stop surfaces 72, 74 are spaced about the pintle 50. The stop surfaces 72, 74 are generally planar and are generally parallel to the first axis A.

The leaf 48 is identical to the leaf 46, except that it does not include a hole in its lower surface equivalent to the hole 70 in the leaf 46. The pintle 50 terminates within the leaf body of the leaf 48, and a lower hole is thus unnecessary in the leaf 48.

With reference to FIGS. 1–7, the structure and operation of the foldable play structure 10 will now be explained. As discussed above, the leaves 42, 44, 46, 48 of the hinge 40, as well as corresponding leaves of the other hinges 140, 240, 340, are interleaved when they are assembled. As seen in FIG. 3, the distance between the leaves 46, 48 is greater than the height of the leaf 44, such that when the hinge 40 is assembled, the leaves 42, 44 and the leaves 46, 48 have space in which to slide relative to each other along the first axis A of the pintle 50. Accordingly, the pintle 50 acts as connecting means for slidably connecting the leaves 42, 44, 46, 48, and the leaves 42, 44, 46, 48 are slidable relative to each other between a pivotable position, wherein the leaves 42, 44 and the leaves 46, 48 may pivot relative to each other about the first axis A, and a latched position shown in FIG. 3. In the latched position, the leaf 42, is moved downwardly relative to the leaf 46 such that the stop projection 54 of the leaf 42 is adjacent the stop projection 66 of the leaf 46. In such a position, the stop surface 60 of the leaf 42 lies adjacent the stop surface 74 of the leaf 46, and the stop surface 62 lies adjacent the stop surface 72. Pivotal movement of the leaves 42, 46 relative to each other about the first axis A is therefore restrained by contact between the stop surfaces 60, 74 and the stop surfaces 62, 72. Each set of stop surfaces 60, 74 and 62, 72 thus acts as restraining means for restraining movement of the leaves 42, 46 relative to each other about the first axis A when the leaves 42, 46 are in the latched position. The leaves 44, 48 are also restrained from pivotal movement relative to each other about the first axis A in a similar manner.

Thus, when the play structure 10 is in an opened position with each of the wall units 12, 14, 16, 18 spaced from each other at roughly a 90 degree angle, the hinges 40, 140, 240, 340 are all in latched positions such that pivotal movement of the wall units 12, 14, 16, 18 about the various axes of the pintles of the hinges 40, 140, 240, 340 is restrained. For example, relative pivotal movement of the wall units 16, 18 about a second axis B of the pintle 250 of the hinge 240 is restrained. Accordingly, in an opened position the play structure 10 is latched to reduce the possibility that the play structure 10 will accidentally fold or collapse while children are playing on it.

When the play structure 10 is not in use, an adult may grasp a handle (not shown) on the inside of the wall unit 12 and a handle 80 on the inside of the wall unit 16, and pull the wall units 12, 16 upwardly relative to the wall units 14, 18. The leaves 42, 44 attached to the wall unit 12, as well as other corresponding leaves of the hinges 140, 240, 340 attached to the wall units 12 and 16, will slide upwardly relative to the leaves 46, 48. When the stop projection 54 of the leaf 42 is completely above the plane of an upper surface 47 of the leaf 46, such that the leaf 42 may pivot freely about the first axis A relative to the leaf 46, a corresponding stop projection of the leaf 44 is also completely above the plane of an upper surface 49 of the leaf 48, such that the leaf 44 also may pivot freely about the first axis A relative to the leaf 48. Leaves of the hinges 140, 240, 340 also are similarly situated at that point. The leaves of the play structure 10 are thus in pivotable positions. To help maintain the leaves 42, 44, 46, 48, for example, in pivotable positions, the medial projections 92 are situate on the pintle 50 such that they are just pulled through the hole 68 of the leaf 46 when the leaves 42, 46 are in the pivotable position. The projections 92 thus contact a top edge of the leaf body 64 around the hole 68, and restrain the leaf 42 from falling back into the latched position. Corresponding medial projections of pintles of the hinges 140, 240, 340 function in the same manner.

Figure 2:
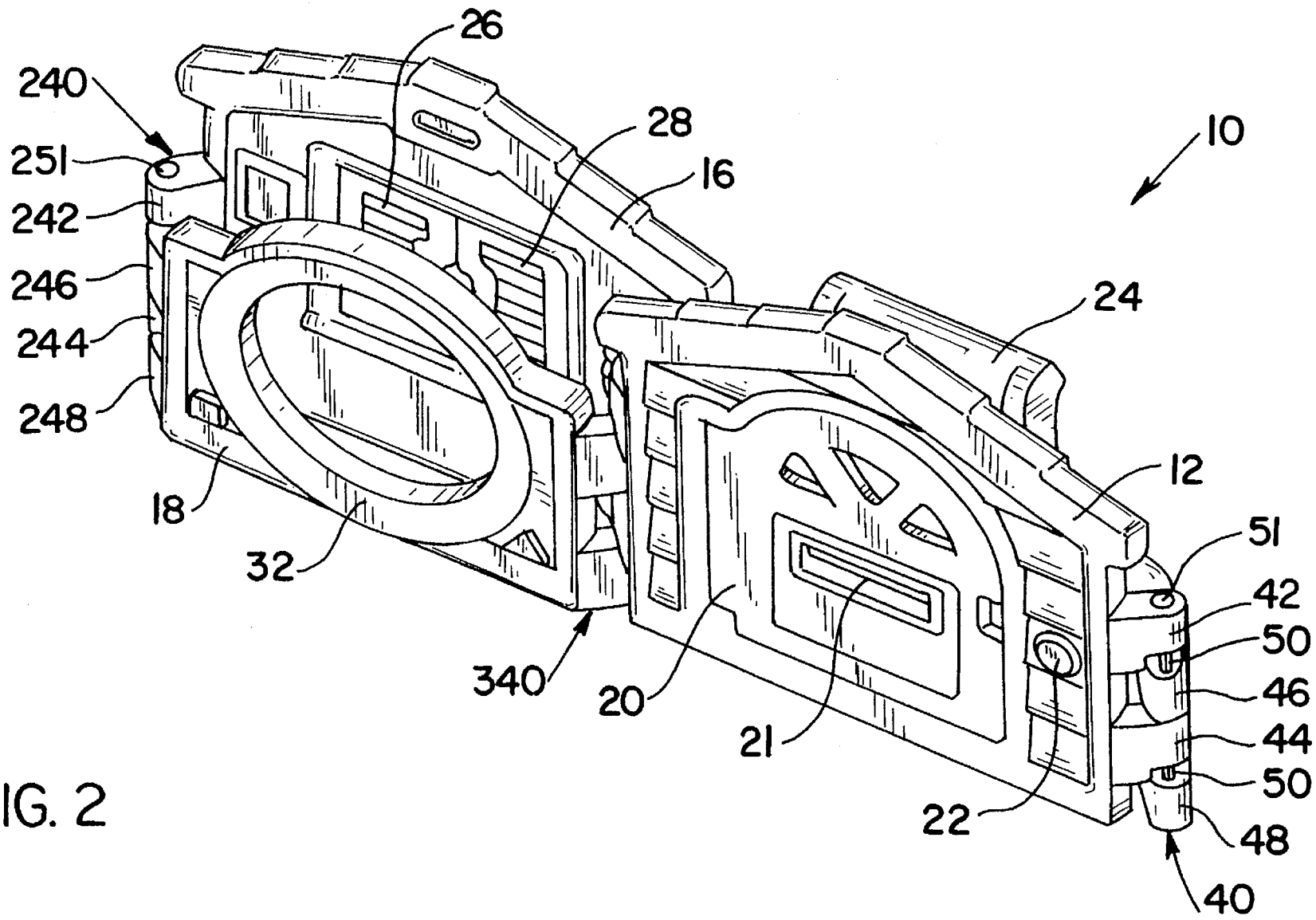
FIG. 2 is a perspective view of the foldable play structure of FIG. 1 in a folded position.

The adult may then freely pivot the wall units 12, 16 until the play structure 10 reaches the folded position shown in FIG. 2, wherein the leaves of the play structure remain in pivotable positions, the wall units 12, 14 are pivoted to positions adjacent each other, and the wall units 16, 18 are pivoted to positions adjacent each other. Alternatively, the adult may pivot the wall units 12, 16 in an opposite manner, such that the wall units 12, 18 are pivoted to positions adjacent each other and the wall units 14, 16 are pivoted to positions adjacent each other. The play structure 10 thus is relatively easily and quickly folded to a more compact shape. To allow easy folding, the first axis A, the second axis B, and the axes of the pintles of the hinges 140, 340 are all generally parallel. Also, to make the folded structure 10 more compact, the slide 24 can be pivoted upwardly such that it also lies adjacent the wall unit 12 or the wall unit 16, whichever is adjacent the wall unit 14.

When the play structure 10 is in the folded position of FIG. 2, it is relatively easily stored out of the way until it is to be used again. The ability of the play structure 10 to be folded and stored makes it well adapted for indoor use as well as outdoor use. When the play structure 10 is to be used again, an adult need only pivot the wall units 12, 14, 16, 18 back to the opened position, then push the wall units 12, 16 downwardly relative to the wall units 14, 18 such that the leaves 42, 44, 46, 48, as well as the leaves of the other hinges 140, 240, 340 slide into latched positions. The play structure is thus relatively easily and quickly moved from a folded position to a latched, opened position.

It should be understood that the play structure 10 could include as many as three freely-pivotable hinges in place of three of the axially latchable hinges 40, 140, 240, 340, and the play structure 10 still would be substantially latchable in an opened position. In other words, if the axially latchable hinge 40 remained, but the hinges 140, 240, 340 were replaced with standard freely-pivoting hinges, the hinge 40 would substantially restrain relative pivotal movement of the walls unit 12, 14, 16, 18 when the hinge 40 was in a latched position. Restraint would occur because the wall units 12, 14 would be restrained directly by the hinge 40, and because the wall units 16, 18 would have very little freedom of movement since they would be connected at first ends thereof to fixed points, i.e, the wall units 12, 14, and they would be connected to each other at second, opposite ends thereof.

The play structure 10 also could be designed such that in a latched, opened position it would present an open structure rather than a closed loop. For example, the wall units 12, 14, 16, 18 could be connected by hinges such that the play structure formed an arcuate curve or other open shape rather than a closed loop. If such an open structure was adopted, one less hinge would be required, but all three of the remaining hinges would be latchable, such as are axially latchable hinges, to restrain relative pivotal movement of the wall units 12, 14, 16, 18.

It should also be appreciated that the play structure 10 of the present invention could in another embodiment include more than four wall units. For example, play structures of the present invention could include five, six, or seven wall units if desired. If the play structure was formed as a closed loop, the structure would include the same number of hinges as the number of wall units. Thus if six wall units were present, six hinges would be used to form the closed loop. The number of axially latchable hinges could vary. All of the hinges could be axially latchable for maximum safety, or, if desired, less than all of the hinges would be latchable. In general, if there are n wall units in a closed loop play structure, a minimum of n-3 latchable hinges, such as axially latchable hinges, should be used to substantially restrain relative pivotal movement of all of the wall units. Thus a closed loop, six wall unit structure would use at least three latchable hinges. If the structure is formed as an open structure, one less hinge would be required than the number of wall units. As above, however, all of the hinges would be latchable, such as through the use of axially latchable hinges, to restrain relative pivotal movement of the wall units.

It should be appreciated that, although the stop surfaces 60, 62, 72, 74 are disclosed as being generally planar and as extending generally parallel to the first axis A, various modifications thereto are within the scope of the present invention. For example, the stop surfaces 60, 74 and the stop surfaces 62, 72 could be mating nonplanar surfaces which are generally parallel to the first axis A. The stop surfaces 60, 62, 72, 74 could be planar surfaces arranged at angles to the first axis A, if the stop surfaces 60, 74 and the stop surfaces 62, 72 lie adjacent each other when the leaves 42, 46 are in the latched position. Also, the stop surfaces 60, 74 and the stop surfaces 62, 72 could be mating nonplanar surfaces which are angled relative to the first axis A.

It should also be understood that, if desired, the hinge 40 may be assembled such that the pintle 50 is inserted from the bottom of the hinge 40, through the leaves 48, 46, 44 and into the leaf 42. In such a case, the projections 90 would retain the pintle 50 to the leaf 48, and the projections 92 would contact a lower edge of one of the holes in one of the leaves 42, 44. Also, if desired, the pintle 50 could be omitted and replaced with a pair of pintle projections extending from the bottoms of the leaves 42, 44 into the leaves 46, 48.

The principles, a preferred embodiment and the mode of operation of the present invention have been described in the foregoing specification. However, the invention which is intended to be protected is not to be construed as limited to the particular embodiment disclosed. The embodiment is therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. A foldable play structure, comprising:

a first wall unit;

a second wall unit; and a first axially latchable hinge, said first hinge including a first leaf attached to said first wall unit, a second leaf attached to said second wall unit, and a first pintle extending through said first and second leaves along a first axis, said first and second leaves being slidable relative to each other along said first axis between a pivotable position, wherein said first and second leaves may pivot relative to each other about said first axis, and a latched position, wherein pivotal movement of said first and second leaves about said first axis is restrained.

2. A foldable play structure as claimed in claim 1, wherein said play structure is movable between an opened position, wherein said first and second leaves are in said latched position and said first and second wall units are spaced from each other, and a folded position, wherein said first and second leaves are in said pivotable position and said first and second wall units are pivoted to positions adjacent each other.

3. A foldable play structure as claimed in claim 1, wherein said first leaf includes at least one first stop surface thereon and said second leaf includes at least one second stop surface thereon, said first and second stop surfaces lying adjacent each other when said first and second leaves are in said latched position, to restrain relative pivotal movement of said first and second leaves about said first axis.

4. A foldable play structure as claimed in claim 3, wherein said first and second stop surfaces extend generally parallel to said first axis.

5. A foldable play structure as claimed in claim 1, wherein said first leaf includes a pair of first stop surfaces thereon spaced about said pintle, and said second leaf includes a pair of second stop surfaces thereon spaced about said pintle, said pairs of stop surfaces lying adjacent each other when said first and second leaves are in said latched position, to restrain relative pivotal movement of said first and second leaves about said first axis.

6. A foldable play structure as claimed in claim 1, wherein said hinge includes a pair of first leaves attached to said first wall unit and a pair of second leaves attached to said second wall unit, said pairs of leaves being interleaved along said pintle such that each of said first leaves lies directly above one of said second leaves.

7. A foldable play structure as claimed in claim 1, further including a third wall unit, a fourth wall unit, and a second axially latchable hinge, a third axially latchable hinge, and a fourth axially latchable hinge, wherein said second axially latchable hinge connects said second wall unit to said third wall unit, said third axially latchable hinge connects said third wall unit to said fourth wall unit, and said fourth axially latchable hinge connects said fourth wall unit to said first wall unit, such that said wall units form a closed loop play structure.

8. A foldable play structure as claimed in claim 7, wherein said second axis is generally parallel to said first axis.

9. A foldable play structure as claimed in claim 1, wherein said first and second wall units and said first and second leaves are formed of blow-molded plastic.

10. A foldable play structure, comprising:

a first wall unit;

a second wall unit; and a first axially latchable hinge, said first hinge including a first leaf attached to said first wall unit, a second leaf attached to said second wall unit, first restraining means for restraining movement of said first and second leaves relative to each other about a first axis, and first connecting means for slidably connecting said first and second leaves to enable said first and second leaves to slide relative to each along said first axis between a latched position, wherein said first restraining means restrains pivotal movement, and a pivotable position, wherein said first and second leaves may pivot relative to each other about said first axis.

11. A foldable play structure as claimed in claim 10, wherein said play structure is movable between an opened position, wherein said first and second leaves are in said latched position and said first and second wall units are spaced from each other, and a folded position, wherein said first and second leaves are in said pivotable position and said first and second wall units are pivoted to positions adjacent each other.

12. A folding play structure as claimed in claim 11, wherein said connecting means includes a pintle extending through said first and second leaves.

13. A foldable play structure as claimed in claim 10, wherein said restraining means includes at least one first stop surface on said first leaf and at least one second stop surface on said second leaf, said first and second stop surfaces lying adjacent each other when said first and second leaves are in said latched position.

14. A foldable play structure as claimed in claim 13, wherein said first and second stop surfaces extend generally parallel to said first axis.

15. A foldable play structure as claimed in claim 10, wherein said restraining means includes a pair of first stop surfaces on said first leaf spaced from each other, and a pair of second stop surfaces on said second leaf spaced from each other, said pairs of stop surfaces lying adjacent each other when said first and second leaves are in said latched position.

16. A foldable play structure as claimed in claim 10, further including a third wall unit, a fourth wall unit, a second axially latchable hinge, a third axially latchable hinge, and a fourth axially latchable hinge, wherein said second axially latchable hinge connects said second wall unit to said third wall unit, said third axially latchable hinge connects said third wall unit to said fourth wall unit, and said fourth axially latchable hinge connects said fourth wall unit to said first wall unit, such that said wall units form a closed loop play structure.

17. A foldable play structure as claimed in claim 16, wherein said second axis is generally parallel to said first axis.

18. A foldable play structure as claimed in claim 10, wherein said first and second wall units and said first and second leaves are formed of blow-molded plastic.

* * * * *